US005615918A

United States Patent [19]

Ferrell

[11] Patent Number: 5,615,918

[45] Date of Patent: Apr. 1, 1997

[54] GLASS DOOR RELEASE SYSTEM

[76] Inventor: W. Stuart Ferrell, 1244 Lanier Rd., Martinsville, Va. 24112

[21] Appl. No.: 356,855

[22] Filed: Dec. 15, 1994

[51] Int. Cl.[6] ..... E05B 65/10

[52] U.S. Cl. ..... 292/92; 292/336.3

[58] Field of Search ..... 292/92, 144, 251.5, 292/93, 336.3

[56] References Cited

U.S. PATENT DOCUMENTS 1,165,436 12/1915 Mochau ..... 292/93

4,976,476 12/1990 Cross et al. ..... 292/92

*Primary Examiner*—Rodney M. Lindsey

*Attorney, Agent, or Firm*—Rhodes Coats & Bennett, L.L.P.

[57] ABSTRACT

A door with a "panic" release handle including a conductive release segment mounted directly onto a frameless glass panel with non-conductive spacers to isolate a sensor circuit adapted to release a lock communicating with the circuit.

15 Claims, 2 Drawing Sheets

FIG. 5
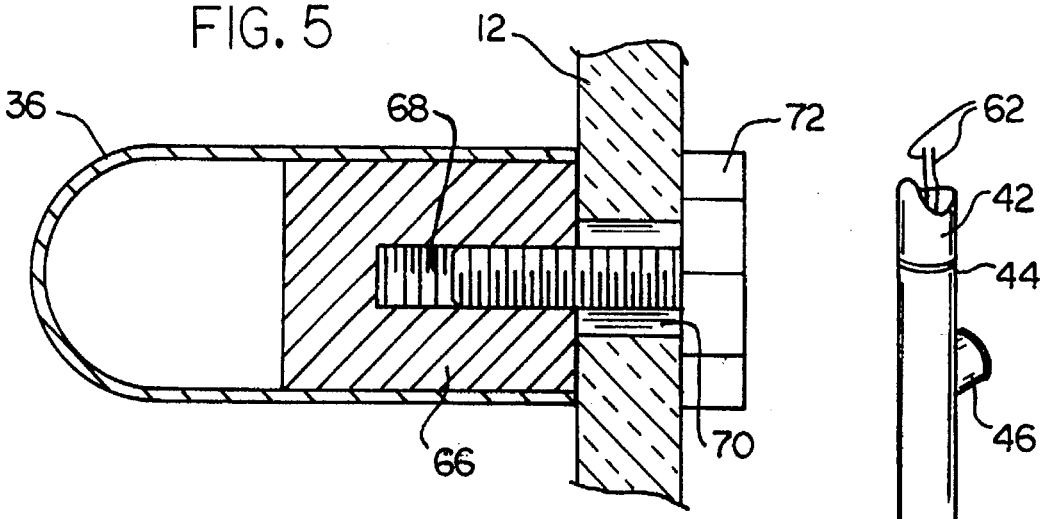
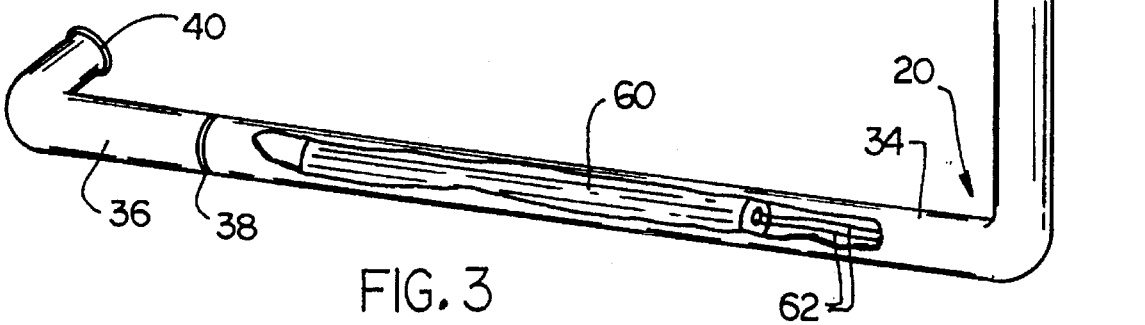
FIG. 3
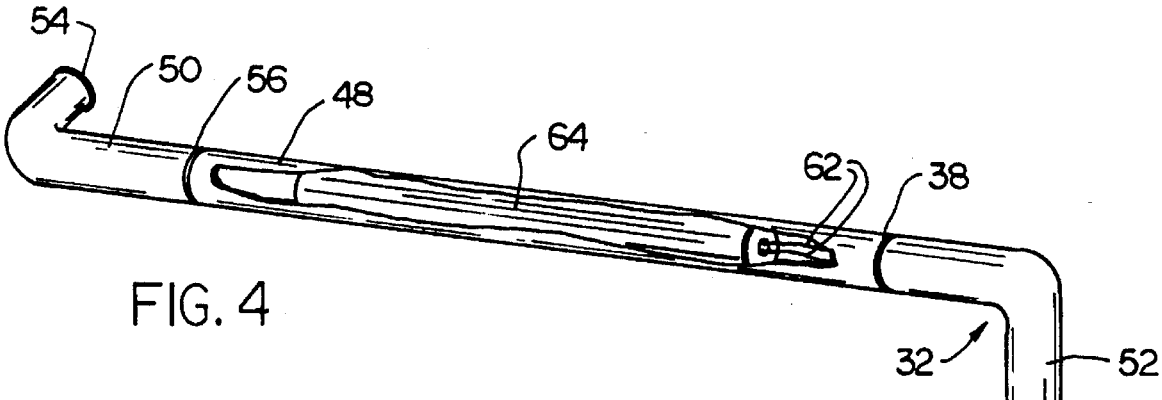
FIG. 4
FIG. 6
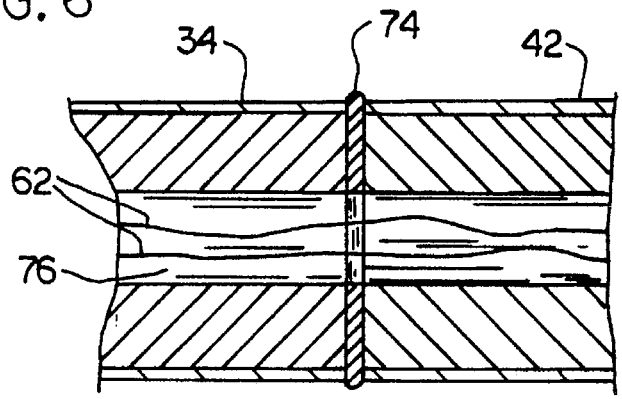

GLASS DOOR RELEASE SYSTEM

BACKGROUND OF THE INVENTION

1. Field of the Invention

The present invention relates generally to a glass door having a handle system for releasing a door latch, and, more particularly, to a door having an opening system of the "panic" type mounted on a glass door panel and suitable for use in releasing a look attached to an edge of the glass door.

2. Description of the Prior Art

Building codes and other safety regulations normally require that locked doors within offices and other facilities include a quick release or "panic" latch, allowing persons within the interior of the facility to readily open the door by simply pushing on an interior handle. From the exterior, however, the door latch or lock is released by a key, key pad, or other controlled lock release means. The lock may be a mechanical lock, a magnetic lock or an electro-mechanical lock, such as a lock operable by a solenoid. With these latter two locks, the release is effected by a change in current within a circuit which includes the lock.

Various panic-type door handles are known in the prior art. For example, U.S. Pat. No. 4,711,480 to Horgan, Jr., discloses a door handle having a horizontal component and a vertical component extending upwardly from the horizontal component to a pivotal attachment near the top of the door. A locking mechanism, which may be mechanical or magnetic, extends outwardly from the top of the vertical component and into engagement with the door frame. When the horizontal component of the handle is moved toward the door, a mechanical linkage within the vertical component of the handle withdraws the latching mechanism from the door frame, permitting the door to be opened.

U.S. Pat. No. 4,895,399 to Horgan, Jr. describes another kind of mechanically operable panic handle, in which one end is pivotally attached to the door. A pivotal latch having an outer position and an inner position is mounted on the door, and engages the door frame when in the extended position. Pushing on the door handle presses the unattached end of the handle against the latching mechanism, withdrawing it from engagement with the door frame.

Mechanical devices as illustrated by the above inventions are complex to manufacture and, therefore, difficult to maintain. A much less complicated release device with no moving parts, and thus very low maintenance, is described in U.S. Pat. No. 4,871,204 to Cooke, et. al., which uses a lock including an electromagnet mounted on the door frame to engage a striker plate mounted on the door. The electromagnet is in a sensor circuit which is responsive to changes in capacitance, along with a switch , a power source and a conductive door handle. When a person desiring to open the door touches the door handle, the capacitance within the circuit is changed, deactivating the electromagnetic lock. The Cooke et al door has gained commercial success. The mechanism, however, is only usable on certain door structures which have a frame for mounting the release mechanism. Specifically, as described in the sales brochure from Securitron, the assignee of the Cooke et al patent, the door can be an aluminum frame door, a hollow metal door, or a wood door.

Of considerable commercial importance is the fact that the Cooke et al invention, is not applicable to solid glass doors, i.e., doors including a glass panel without a frame or edging around its periphery. Doors of this construction, however, are of increasing use in the building trades, and a need exists for a latch release system for these solid glass doors that is both functional and attractive.

Thus, there remains a need for a new and improved solid glass door having a latch or lock component mounted on an edge thereof and a release mechanism mounted on the glass door panel adapted to release the lock when the release mechanism is contacted by a person seeking to open the door.

SUMMARY OF THE INVENTION

The present invention is directed to a door including a frameless glass panel, i.e., a glass door panel without an edging along its vertical edges, and a release handle including a conductive segment mounted directed onto the glass panel. A lock housing attached to one edge of the glass panel houses a locking component which cooperates with another locking component on a door frame spaced about the door opening into which the glass panel is fitted.

A sensor circuit responsive to variations in capacitance is positioned in communication with the conductive handle segment, a power supply, and a locking component, so that a variation in capacitance caused by a user engaging the conductive handle segment will switch the lock from a locked state to an unlocked state. Significantly, the conductive handle segment is isolated by non-conductive spacers from other areas which could cause a capacitance variance by non-conductive spacers.

The frameless glass panel is formed of tempered glass to meet safety requirements and building codes. At least one, and normally two or more, holes are drilled through the door panel prior to tempering, so that the handle to be discussed in greater detail hereinafter can be mounted directly onto the glass panel with nonconductive fasteners. The lock housing, which may be a header extending across the top of the glass panel or a footer extending across the bottom of the glass panel, serves to hold a lock component, generally the latch or armature of a lock. In addition, the lock housing includes a hinge mount for attaching the glass panel to a surrounding door frame. The lock housing is normally constructed of metal, such as aluminium, and clad in various finishes, such as stainless steel or brass.

The lock employed in the present invention is of a type which is switchable from a locked state to an unlocked state by a change in current flow within a circuit including the lock. For example, the lock may be an electromagnetic lock including an electromagnet component within the lock housing, or on the door frame, and a plate or armature component on the other surface. Alternatively, the lock may be of the solenoid type, where one component includes a latch actuated by a solenoid and the other lock component includes a latch receiving slot.

The handle of the present invention includes a conductive, handle release segment, normally forming an inner segment of the handle, insulated from other conductive door components by non-conductive fasteners or spacers. The handle release segment may be in the form of an elongated tube having opposed ends. The tube may be of different cross sections, e.g., circular or rectangular, and is hollow in order to receive the sensor circuit to be discussed hereinafter.

In the preferred embodiment, the handle includes a first end segment extending from the handle release segment to the glass panel, and a second end segment extending from the opposed end of the handle release segment to the lock housing. The end segments are, for aesthetic reasons, usually of the same cross-sectional dimensions and of the same construction as the inner conductive handle segment. For example, the end segments may be tubular and formed of a conductive material, such as brass or stainless steel.

The overall handle may be of various shapes depending on the desires of the designer and the restrictions of building and safety codes and regulations which, for example, frequently require the actuating "panic" handle of a door to be in a horizontal position. Thus, in the preferred embodiment, the handle will include a horizontal component which includes the conductive, handle release segment. The remainder of the handle may include a generally vertical component extending either upwardly or downwardly to engage the lock housing.

Since the lock of the present invention is released by a change on capacitance which can be caused by contact of a person with any conductive surface in communication with the sensor circuit or the conductive handle release segment which is in communication with the sensor circuit, it is necessary to insulate other conductive door components from the handle release segment. The other conductive door components may include the end segments of the door handle, and metallic components of fasteners used to mount the handle onto the glass panel. This insulation is achieved by placing a non-conductive spacer between the release handle segment and the other conductive door component. The spacer may be formed of any structural, non-conductive material, e.g., a plastic material such as Delrin or Garolite.

Thus, when metallic handle end segments are used, a non-conductive fastener or spacer is positioned between each end segment and the handle release segment. This spacer may include an outer end insertable within the interior of the end segment, and an inner end insertable within the interior of the release segment. An annular flange may extend outwardly from the spacer for positioning between the edges of the segments. When the handle segments are of a cylindrical, tubular shape, for example, the spacer ends may be of a cylindrical shape with an outer diameter equal to the inner diameter of the handle segments. An opening, generally circular and axially aligned, extends through the spacer when it is desired to extend wiring forming a part of the sensor circuit from within the release segment through an end segment.

The fastener used to join the handle to the door may also include a metallic component, e.g., a threaded bolt extending from the opposite side of the door through a mounting hole into engagement with the handle. Insulation of these components is especially essential since the lock could be released from the outside simply by touching the bolt. This risk may be avoided by securing the handle to the door with a fastener that includes a non-conductive spacer between the handle and any conductive fastener components used to secure the handle to the glass panel.

When securing a handle with a hollow interior, e.g., a tubular handle, to the glass panel, the fastener may include a threaded bolt extending through a mounting hole in the glass panel, and a spacer in the form of a nonconductive bolt receiver fitted into the end of the handle segment adjacent the glass panel. As with the above spacer, the exterior dimensions of the spacer will correspond to the interior dimensions of the handle segment interior into which the spacer is inserted. The spacer will also include a bolt receiving opening, e.g., a threaded axial bore.

The sensor circuit is preferably housed inside the conductive handle release segment, and is responsive to variations in capacitance resulting from a user contacting the release handle segment. The sensor circuit includes wiring extending from the interior of the inner handle segment through a handle end segment to a lock component, so that it can communicate with a lock component. The circuit may include the lock component within the lock housing, or the lock component within the door frame. In this latter instance, the wiring will extend from the lock housing, e.g., through the hinge mounting, into the door frame.

The sensor circuit may be of various constructions known in the prior art, provided the circuit is sensitive to a change in capacitance, so that the lock which is in the circuit will disengage. As an example, the sensor circuit may be of the construction described in U.S. Pat. No. 4,871,204 to Cooke, et. al., the disclosure of which is incorporated herein in its entirety. Other structures will be apparent to one skilled in the art.

Accordingly, one aspect of the present invention is to provide a door including: (a) a frameless glass panel; (b) a lock housing on one edge of the panel; (c) a handle mounted on the panel, the handle including a conductive segment; (d) a sensor circuit responsive to variations in capacitance of the conductive handle segment is association with the conductive handle segment; and (e) a lock connected in the circuit, the lock being switchable between a locked state and an unlocked state by a change in current flow within the circuit.

Another aspect of the present invention is to provide a door including: (a) a frameless glass panel having a lock housing attached to one edge; (b) a handle having a conductive inner segment, a first end segment extending from the inner segment to the glass panel, and a second end segment extending from the inner segment to the lock housing; (c) a non-conductive spacer between an inner segment and the glass panel; (d) a sensor circuit responsive to variations in capacitance of the conductive handle segment is association with the conductive handle segment; and (e) a lock within the circuit, the lock being switchable from a locked state to an unlocked state by a change in current flow within the circuit.

Still another aspect of the present invention is to provide a door including: (a) a frameless glass panel having at least one mounting hole therein; (b) a lock housing on one edge of the panel; (c) a handle including a conductive segment; (d) at least one non-conductive fastener securing the handle to the panel; (e) a sensor circuit responsive to variations in capacitance of the conductive handle segment is association with the conductive handle segment; and (f) a lock within the circuit, the lock being switchable between a locked state and an unlocked state by a change in current flow within the circuit.

These and other aspects of the present invention will become apparent to those skilled in the art after a reading of the following description of the preferred embodiment when considered with the drawings.

BRIEF DESCRIPTION OF THE DRAWINGS

FIG. 3 is a detailed view of the handle of the door in FIG. 1, cut away to show the interior;

FIG. 4 is a detailed view of the handle of the door in FIG. 2, cut away to show the interior;

FIG. 5 is a detailed sectional side view of the connection of handle end piece, showing its connection to the door panel; and FIG. 6 is a sectional side view showing the manner of connection of the central portion of the handle to an end piece.

DESCRIPTION OF THE PREFERRED EMBODIMENTS

Figure 2:
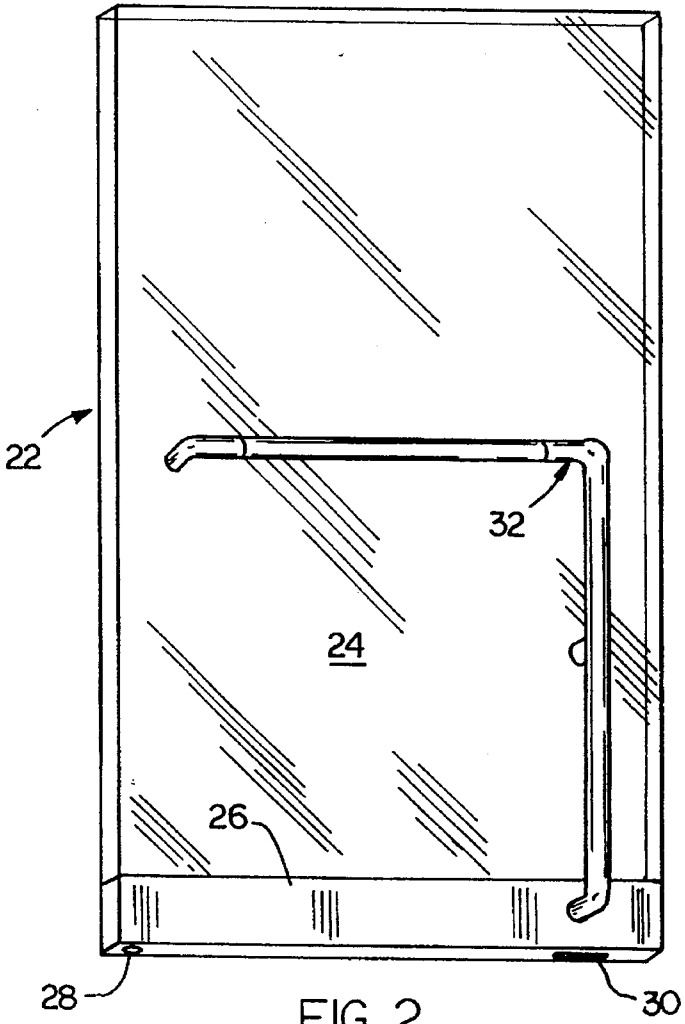
FIG. 2 is a door of the present invention in which the locking mechanism is in a footer.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
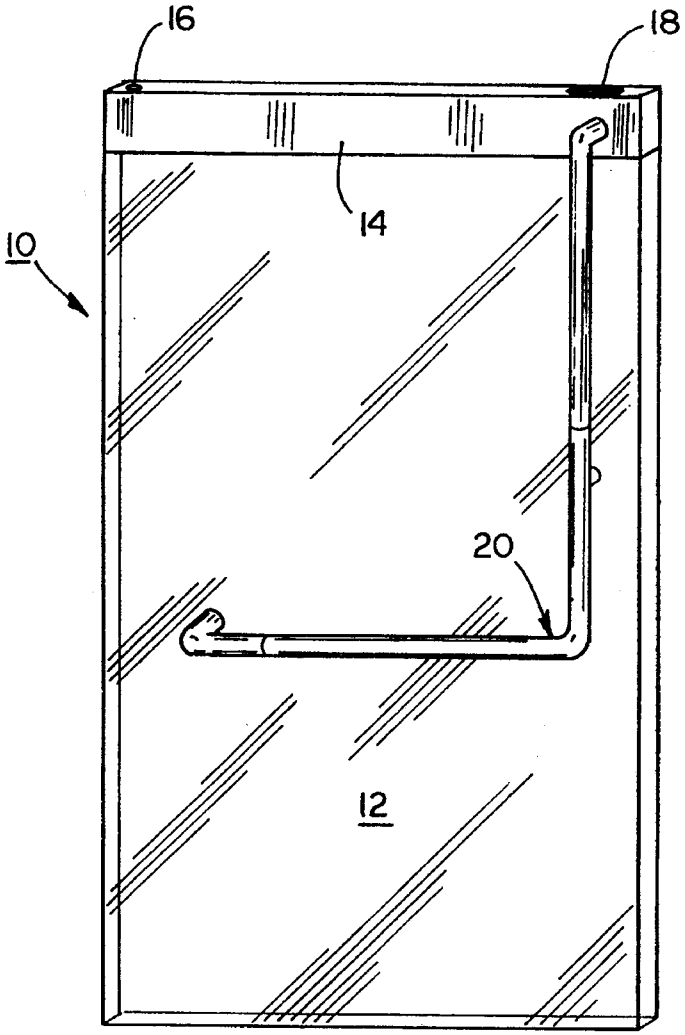
FIG. 1 is a perspective view of a door constructed according to the present invention in which the locking mechanism is in a header.

Referring now to the drawings in general and FIG. 1 in particular, it will be understood that the illustrations are for the purpose of describing a preferred embodiment of the invention and are not intended to limit the invention thereto. As best seen in FIG. 1, a door, generally designated 10, is shown constructed according to the present invention. The door 10 includes a frameless glass panel 12, a header 14, having incorporated therein a hinge mounting 16 for use in attaching door 10 to an exterior door frame, not shown. Header 14 also includes a lock component 18, e.g., a lock latch or armature. A handle, generally 20, is mounted directly onto glass panel 12.

Door 22, shown in FIG. 2, is an alternative embodiment of door 10. Door 22 includes a frameless glass panel 24, having a footer 26 attached to its lower edge. Footer 26 includes a hinge mounting 28, and a lock component 30. A handle, generally 32, is mounted directly onto glass panel 24.

Handle 20 in FIG. 1, illustrated in greater detail in FIG. 3, includes an inner release segment 34, positioned horizontally at a level where it can be readily reached by a person seeking to open the door. Segment 34 is supported in the desired position by an inwardly curved, horizontal end segment 36, which has one end secured to the segment 34 by spacer 38, and its other end attached to glass panel 12 by fastener 40 in a manner hereinafter described. A second handle end segment 42 extends from the opposite end of handle release segment 34, vertically upward to header 14, and is secured thereto. A second spacer 44 joins segment 42 to release segment 34. A mounting member 46, also secures handle 20 to glass panel 12.

Handle 32 in FIG. 2, illustrated in greater detail in FIG. 4, similarly includes a horizontally mounted, release segment 48, held in the desired position by a horizontal end segment 50 extending from one end of segment 48 to glass panel 24, and another end segment 52, extending from the opposite end of segment 48 downwardly to footer 26. A fastener 54 also secures handle 32 to glass panel 24. Spacers 56 and 38 join segment 48 to handle segments 50 and 52, respectively.

As best shown in FIG. 3, the interior of release segment 34, houses a sensor circuit 60, responsive to changes in conductivity resulting from a user touching segment 34. Sensor 60 is connected by way of wiring 62 extending through the hollow interior of handle segments 34 and 42 to a power supply, not shown, and locking component 18, or a cooperating locking component in the adjacent door frame. Sensor 60 is of the construction described in U.S. Pat. No. 4,871,204 to Cooke et. al. The interior of release segment 48 of handle 32 also includes a sensor 64, which is of the same construction as sensor 60, connected to a lock component and a power supply by way of wires 62, which extend through segments 48 and 52 to footer 26.

The manner in which handles 20 and 32 are mounted on glass panels 12 and 24, and the manner in which conductive central handle segments 34 and 48 join the remaining handle segments, are significant aspects of the present invention. In order for the sensor circuit to operate effectively, it is essential to isolate the conductive handle segment from other conductive areas of the handle or door which might vary the capacitance of the circuit, resulting in unintentional unlocking of the door.

FIG. 5 illustrates in detail the preferred manner of attaching a handle to a glass door panel. While FIG. 5 specifically illustrates the attachment of the inner end of the handle segment 36 to glass panel 12, it will be apparent that similar means may be employed to attach other parts of the handle to panel 12 or to panel 24. In order to attach the handle to the panel in a secure manner, while insulating the sensor circuit, a fastener is used which includes a non-conductive insert 66 fitted within the end of handle segment 36. Insert 66 has a horizontal, threaded bore 68 centrally therein aligned with a hole 70 through panel 12. A threaded bolt 72 is inserted through hole 70 from the opposite side of panel 12 and threaded into the bore 68. As a result, handle 20 is held firmly against glass panel 12, but is insulated from any undesirable influences upon conductivity or capacitance by insulating insert 66.

It is similarly desirable to isolate the conductive release segment 34 of handle 20 from end segments 36 and 42. This isolation is achieved by joining interior release segment 34 to the end segments 36 and 42 with intermediate, non-conductive spacers 38 and 44 of the type shown in FIG. 6. While the spacer illustrated is spacer 44 in FIG. 3, it will be understood that the other spacers used in the construction of handle 20 or handle 32 will have a similar construction. Spacer 44 is of a cylindrical configuration with an outer diameter substantially equal to the inner diameter of handle segments 34 and 42, so that the insert can be snugly fitted within the interior of these segments. An annular ridge or flange 74 extends outwardly from the insert approximately equal distance between the insert ends, and is positioned between the facing edges of segments 34 and 42, so that the ends thereof do not come into contact with one another. The insert also includes an axial bore 76 through which wiring 62 can be inserted and held away from the inner walls of segments 34 and 42. This bore is not required in spacers 38 and 56.

The resultant door is both decorative and functional, and has no moving parts, so that it is easy to maintain. In operation, the person desiring to open the door simply touches handle release segment 20 or 32 This touch results in a difference in capacitance within the sensor circuit 60 or 64 inside the handle. The resultant change in capacitance alters the flow of current through the circuit to unlock the lock by discontinuing current flow to the lock. It will, of course, be apparent to one skilled in the art that a circuit can also be constructed whereby change in capacitance results in the initiation of electrical current flow through the circuit to unlock a locking mechanism. The choice of the circuit will depend upon whether it is desired to have the lock activated or deactivated by an electrical current.

Certain modifications and improvements will occur to those skilled in the art upon a reading of the foregoing description. By way of example, a handle can also be mounted on the opposite side of the glass panel. Also, handles and door shapes other than those illustrated can be used. It should be understood that all such modifications and improvements have been deleted herein for the sake of conciseness and readability but are properly within the scope of the following claims.

I claim:

1. A door comprising:

(a) a frameless glass panel;

(b) a lock housing on one edge of said panel;

(c) a handle mounted on said panel, said handle including a conductive inner segment and an end segment extending from said inner segment to said lock housing;

(d) a sensor circuit responsive to variations in capacitance at said conductive inner segment in electrical communication with said conductive inner segment;

(e) non-conductive spacers to insulate said conductive inner segment from said end segment; and (f) a lock connected in said circuit, said lock being switchable between a locked state and an unlocked state by a change in current flow within said circuit.

2. The apparatus according to claim 1, wherein said lock housing is in the form of a footer extending across the bottom of said glass panel.

3. The apparatus according to claim 1, wherein said lock is a magnetic lock.

4. The door of claim 1, wherein said sensor circuit is housed inside said conductive inner segment.

5. The apparatus according to claim 1, wherein said lock housing is in the form of a header extending across the top of said glass panel.

6. A door comprising:

(a) a frameless glass panel having a lock housing attached to one edge;

(b) a handle having a conductive inner segment, a first end segment extending from said inner segment to said glass panel, and a second end segment extending from said inner segment to said lock housing;

(c) a non-conductive spacer between said inner segment and said glass panel;

(d) a sensor circuit responsive to variations in capacitance at said conductive inner segment in electrical communication with said conductive inner segment; and (e) a lock within said circuit, said lock being switchable from a locked state to an unlocked state by a change in current flow within said circuit.

7. The door of claim 6, wherein said sensor circuit includes wiring extending from the interior of said inner segment through said second end segment to said lock housing.

8. The apparatus according to claim 6, wherein said conductive inner segment is tubular.

9. The apparatus according to claim 6, wherein said handle has a horizontal component.

10. The apparatus according to claim 9, wherein said handle inner segment forms a part of the horizontal component of said handle.

11. The door of claim 6, wherein said non-conductive spacer is positioned between said inner segment and said first end segment.

12. The door of claim 6, wherein said nonconductive spacer is positioned between said first end segment and said glass panel.

13. A door comprising:

(a) a frameless glass panel having at least one mounting hole therein;

(b) a lock housing on one edge of said panel;

(c) a handle including a conductive handle segment extending to said lock housing;

(d) at least one non-conductive fastener securing said handle to said panel;

(e) a sensor circuit responsive to variations in capacitance at said conductive handle segment in electrical communication with said conductive handle segment; and (f) a lock within said circuit, said lock being switchable between a locked state and an unlocked state by a change in current flow within said circuit.

14. The apparatus according to claim 13, wherein said fastener includes a bolt extending through a mounting hole in said glass panel, and a non-conductive bolt receiver extending into said handle.

15. The apparatus according to claim 13, wherein said handle is hollow and said fastener extends into the interior of said handle.

* * * * *